United States Patent [19]

Ingersoll et al.

[11] 4,369,715

[45] Jan. 25, 1983

[54] RESILIENT HINGE ASSEMBLY FOR A DISPLAY STRUCTURE

[75] Inventors: Brian Ingersoll, Marietta; Ferris L. Hutchins, Jr., Doraville, both of Ga.

[73] Assignee: The Mead Corporation, Dayton, Ohio

[21] Appl. No.: 174,080

[22] Filed: Jul. 31, 1980

[51] Int. Cl.[3] ..... A47F 5/12

[52] U.S. Cl. ..... 108/2; 16/226; 211/49 S

[58] Field of Search ..... 108/2, 134; 211/49 S, 211/134, 150; 248/240.4; 16/150, 157, 184

[56] References Cited

U.S. PATENT DOCUMENTS

| | | | |
|---|---|---|---|
| 426,597 | 4/1890 | Libbey | 16/184 |
| 2,241,101 | 5/1941 | Teeter | 16/150 |
| 2,829,081 | 4/1958 | Sweem | 16/150 |
| 3,343,867 | 9/1967 | Couch et al. | 16/150 |
| 3,388,611 | 6/1968 | Clary et al. | 16/150 X |
| 3,612,288 | 10/1971 | Lesley | 108/2 |
| 3,631,820 | 1/1972 | Taber | 108/2 |
| 3,677,203 | 7/1972 | Barrineau | 211/49 S |
| 3,688,914 | 9/1972 | Taber | 211/49 S |
| 3,744,601 | 7/1973 | Doppelt | 16/150 |
| 4,296,524 | 10/1981 | Horholt et al. | 16/150 |

*Primary Examiner*—Francis K. Zugel

*Attorney, Agent, or Firm*—Erwin Doerr

[57] ABSTRACT

A resilient hinge assembly particularly useful in display structures for merchandising goods comprises a band of plastics material incorporating a central flexible bridge interconnecting a pair of end elements. One of the end elements attaches to a back panel of a display structure and the other end element is slotted to receive a stabilizer shelf for the structure. A leaf spring extends across the flexible bridge and is connected to the end elements for imparting the required degree of restoration force to the assembly.

6 Claims, 2 Drawing Figures

RESILIENT HINGE ASSEMBLY FOR A DISPLAY STRUCTURE

This invention relates to a resilient hinge assembly and to a merchandise display structure incorporating such an assembly. The hinge assembly is particularly, though not exclusively, useful for providing a resiliently hinged connection between a shelf and a back panel of the display structure.

One aspect of the invention provides a resilient hinge assembly comprising a generally flat band of plastics material formed to provide a pair of spaced end elements, a flexible connecting piece integrally joined to said end elements for providing a bendable bridge therebetween, and a leaf spring connected to said end elements and overlying said bendable bridge, wherein said leaf spring imparts a restoring force to the bendable bridge so as to urge the assembly from a strained condition in which said bridge is flexed, into an unstrained condition in which said end elements and said bendable bridge are generally co-planar.

Another aspect of the invention provides a display structure for merchandising goods including a back panel and at least one shelf and a hinge assembly for stabilizing stacked merchandise, in which said hinge assembly comprises a pair of spaced end elements, one of which end elements is secured to said back panel and the other end element having means to receive said shelf and wherein said end elements are integrally joined by a bendable bridge which forms a generally arcuate configuration when the hinge is strained by causing the shelf to adopt a horizontal position ready for use, said bridging being caused to become generally co-planar with respect to said end elements when the hinge is unstrained by allowing the shelf to adopt a vertical position in which said shelf is stowed adjacent said back panel.

Figure 1:
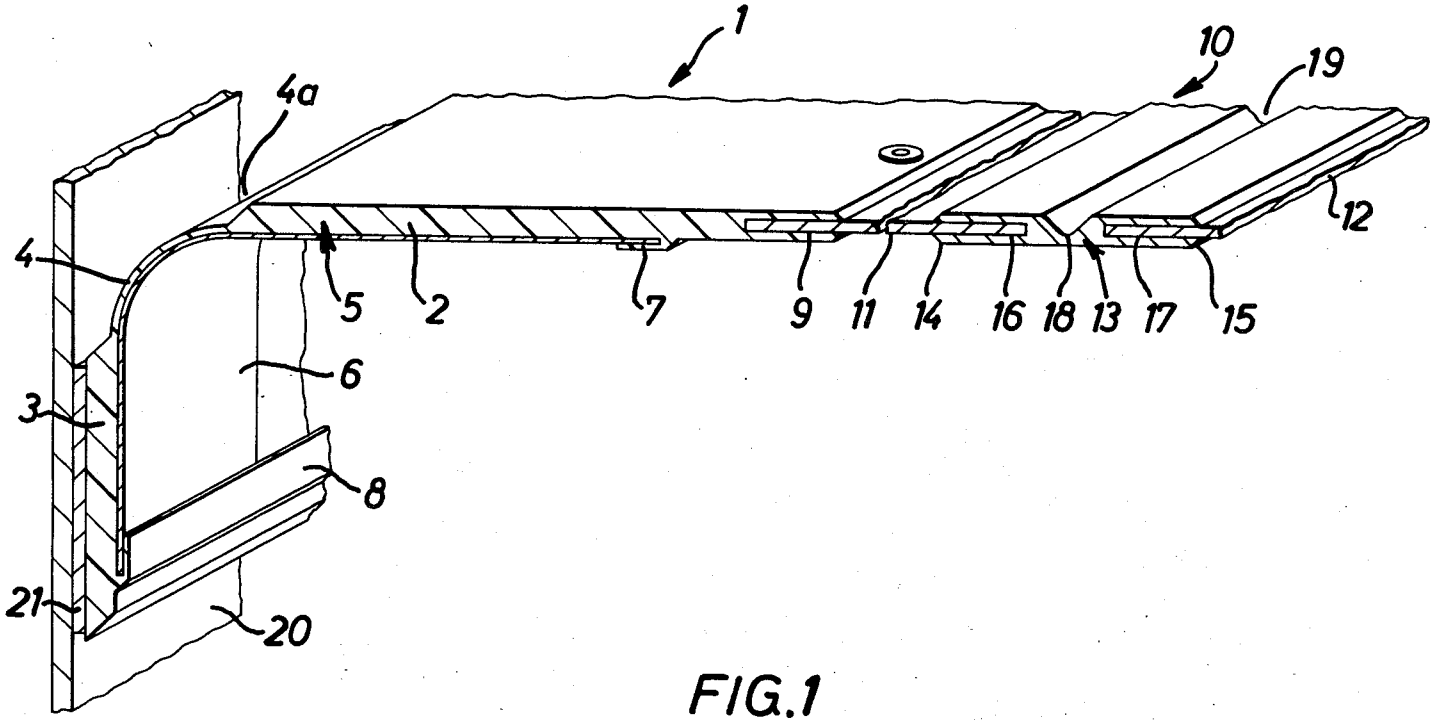
Figure 2:
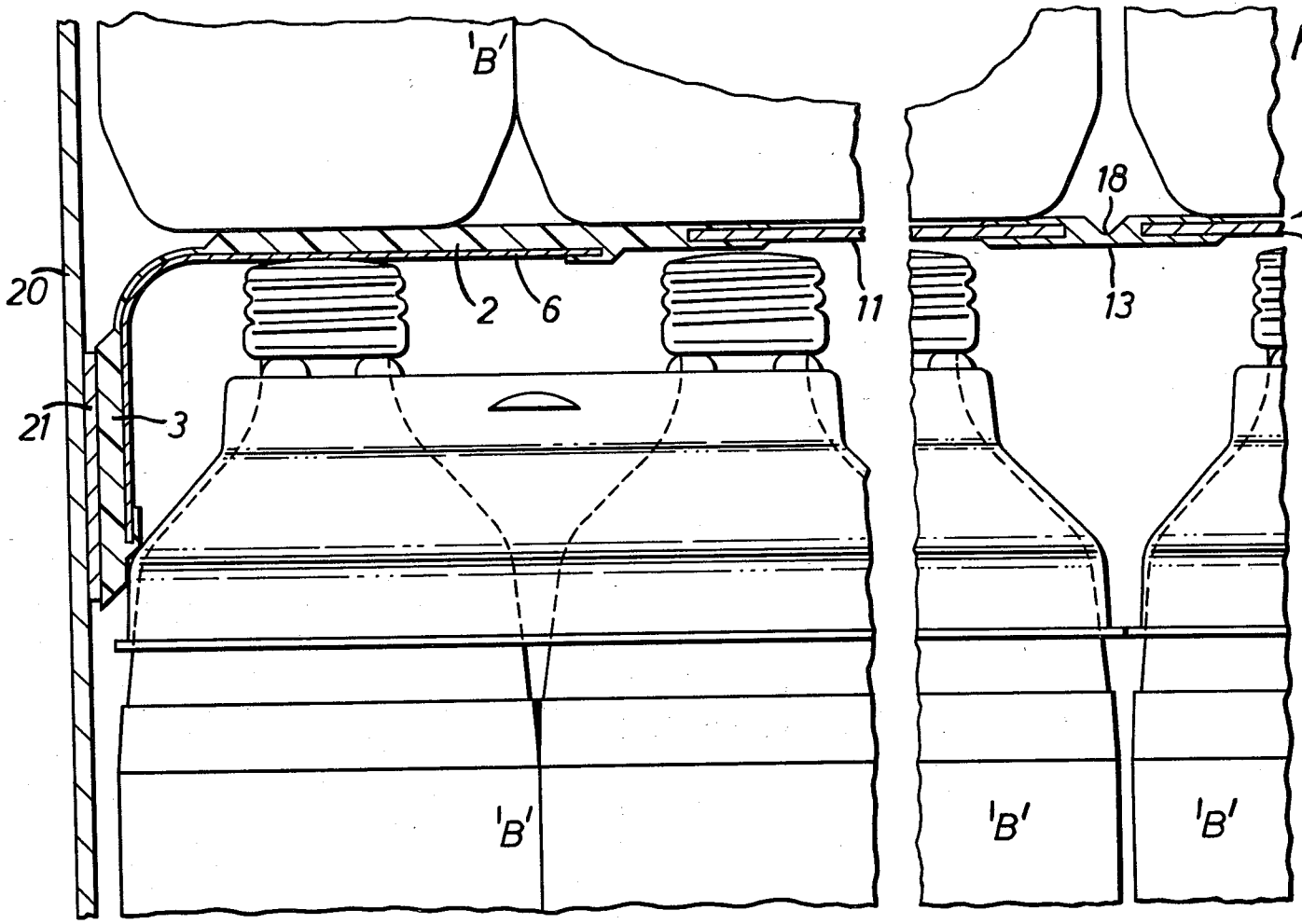

A specific embodiment of the invention, by way of example, is now set forth in the following description taken in conjunction with the accompanying drawings, in which:

FIG. 1 is a side view, in partial cross-section of a shelf and hinge assembly according to the invention, and FIG. 2 is a cross-section of the hinge assembly incorporated in merchandising display structure.

Referring to the drawing, there is shown a resilient hinge assembly 1 comprising a pair of spaced end elements 2, 3 respectively which are interconnected by an integral flexible bridging piece 4. The end elements 2, 3 together with the integral bridging piece 4 form a generally flat band 5 of material when the hinge is unstrained. This band of material is formed by extrusion from a plastics material such as polyethylene but other suitable materials and manufacturing processes may be used.

In order to achieve the required degree of bendability at the bridging piece 4 so that the assembly can be brought into a strained condition by causing the bridging piece 4 to adopt a generally arcuate configuration, the bridging piece 4 has a smaller cross sectional thickness as compared with the end elements 2, 3. This is accomplished by providing a wide groove **4*a* in the upper surface of the band 5. However, it is envisaged that the lower surface or both surfaces of the band could be relieved of the material in order to provide the bendable bridge connection between the end elements 2, 3. Moreover, in the present embodiment the bridging piece 4 is a continuous strip of material although it is envisaged that this strip could be interrupted at spaced locations along its length whereby the bridging piece actually would comprise a series of connecting straps between the end elements 2, 3** respectively.

The required degree of resilience in the hinge assembly between the end elements 2, 3 is provided by a leaf spring 6 of spring steel material which is interconnected between the end elements across the under surface of the plastics band 5. To provide a releasable connection between the leaf spring 6 and the plastics band 5 the underside of each end element 2, 3 is formed with an integral "L"-shaped rib element 7, 8, respectively, located adjacent the opposed free ends of the end elements thus providing a guide channel into which the leaf spring 6 slidably is received. It will be appreciated that the leaf spring 6 tends to restore the hinge assembly into a condition in which the bridging piece is unstrained, i.e. so that the end pieces 2, 3 and the bridging piece are generally co-planar. This restoration force may be varied by varying the gauge of steel used in the leaf spring 6 or, of course, by varying the number of springs inserted into the guide channel 7, 8. In this regard a number of leaf springs 6 may be inserted in side-by-side and/or overlapping relationship or, of course, merely one elongate leaf spring may be used as described herein.

To provide for the attachment of a shelf assembly or some other extension component the free end of end element 2 is bifurcated to form an elongate slot 9 into which one edge of a shelf (generally designated 10) is slotted and secured by suitable fastening means. The shelf may be formed from styrene or some other suitable material. As shown in the drawing the shelf may be articulated so as to provide two relatively foldable portions 11, 12. To provide for articulation of the shelf sections, a connector joint 13 is provided. The connector joint consists of a pair of similar hinge parts 14, 15 which are formed along their outwardly facing free edges with elongate slots 16, 17 respectively. The shelf portion 11 has one longitudinal edge received in the slot 9 of end element 2 and its opposite longitudinal edge received in the slot 16 of hinge part 14. The shell portion 12 has one of its longitudinal edges received in the slot 17 of hinge part 15. The hinge parts are foldably joined along a hinge line 18 extending parallel to the slots 16, 17 and provided by forming a 'V' - shaped groove 19 in the top surface of the hinge connector 13.

The hinge assembly 1 is fitted to an upright back panel 20 of a merchandising display structure or other support by suitable means such as a double sided adhesive tape 21 which bonds end element 3 to the panel 20. However, it is envisaged that other connecting means may be utilized such as riveting or screw fastening.

When the hinge assembly incorporates a shelf for use in a merchandising display strand, the shelf acts as a separator between adjacent vertical stacks of merchandise. To this end the hinge assembly 1 is flexed into its strained condition so that the shelf 10 extends outwardly from the back panel 20 in a generally horizontal plane to engage the tops of the product layer (such as the multi-pack bottle units 'B'). The shelf 10 does not therefore carry the weight of product stacked upon it but rests upon the layer of merchandise below it so that the shelf performs more of a stabilizing function between vertical tiers than a load bearing function.

When the product layer stacked upon shelf 10 is depleted during use, the hinged assembly 1 will be restored by virtue of its resilient construction into its unstrained condition thereby automatically lifting shelf 10 from its horizontal position into a vertical position. During this hinge and shelf movement, the shelf portion 12 will fold about the hinge line 18 of connector joint 13 so that shelf portion 12 swings into face to face relationship with the underside of shelf portion 11. When the hinge assembly has been completely restored to its unstrained condition both it and the shelf 10 are brought into a stowed position parallel to and adjacent the back panel 12. Thus, the display stand will display merchandise so that it is continually available to the customer without being obstructed by shelving and the like.

It is envisaged that the hinge assembly described has applications other than in conjunction with display shelving assemblies. In this regard it may be appropriate to construct the hinge assembly so that the components are strained when the end elements are in their generally co-planar position and unstrained when the end elements are in their angularly related positions.

We claim:

1. A resilient hinge assembly comprising a generally flat band of plastics material formed to provide a pair of spaced end elements, a flexible connecting piece integrally joined to said end elements for providing a bendable bridge therebetween, said bendable bridge being formed by a portion of said band having a reduced thickness in relation to said end elements, and an external leaf spring detachably connected to said end elements and extending along an undersurface of said bendable bridge, wherein said leaf spring imparts a restoring force to the bendable bridge so as to urge the assembly from a strained condition in which said bridge is flexed into a generally arcuate configuration, into an unstrained condition in which said end elements and said bendable bridge are generally co-planar, said hinge assembly further comprising guide means provided by said end elements for releasably receiving said leaf spring in which said guide means comprises integral rib elements depending from said undersurface adjacent the unconnected edges of said end elements, said rib elements each including a portion spaced from the undersurface to provide a slot for receiving an edge portion of said leaf spring.

2. A resilient hinge assembly according to claim 1 in which one of said elements is provided with an elongate slot, for receiving an extension component, said elongate slot being formed along the free edge of said end element remote from the bendable bridge.

3. A shelf and hinge combination for a merchandise display structure which combination comprises a hinge assembly according to claim 2 wherein said extension component is constituted by a shelf detachably received in said elongate slot and extending generally in the same plane as said hinge assembly when in its unstrained condition.

4. The shelf and hinge combination of claim 3 in which said shelf comprises two articulated portions one of said portions having one of its edges received by said hinge assembly and the other of said portions being hinged to the opposite edge of said one portion whereby the shelf portions can be folded into face to face relationship.

5. The shelf and hinge combination of claim 4 in which said articulated shelf portions are separated from one another by a connector joint, said connector joint comprising a pair of similar hinge parts each part having an elongate slot formed therein to receive a marginal edge of one of said shelf portions, said slotted parts being integrally hinged together such that the connecting line extends parallel to the slots in said hinge parts.

6. A merchandising display structure for stabilizing stacked merchandise and including a back panel and at least one shelf and hinge combination as claimed in claim 4, in which said other of the end elements of the hinge assembly is secured to said back panel such that the shelf can be brought into a generally horizontal position by flexing the hinge assembly into its strained condition.

* * * * *